US008726972B1

(12) United States Patent
Wills

(10) Patent No.: US 8,726,972 B1
(45) Date of Patent: May 20, 2014

(54) ROLLER BLIND CLUTCH COVER WITH ANTI-JAM BALL STOP FEATURE

(71) Applicant: Norman Wills, Mississauga (CA)

(72) Inventor: Norman Wills, Mississauga (CA)

( * ) Notice: Subject to any disclaimer, the term of this patent is extended or adjusted under 35 U.S.C. 154(b) by 0 days.

(21) Appl. No.: 13/746,353

(22) Filed: Jan. 22, 2013

(51) Int. Cl.
*E06B 9/56* (2006.01)

(52) U.S. Cl.
USPC ..... 160/321; 160/291; 160/293.1

(58) Field of Classification Search
USPC ..... 160/321, 291, 293.1, 307; 474/203, 154
See application file for complete search history.

(56) References Cited

U.S. PATENT DOCUMENTS

| | | | | | |
|---|---|---|---|---|---|
| 2,564,831 | A * | 8/1951 | Butkus | 188/65.1 |
| 2,577,046 | A * | 12/1951 | Svirsky | 160/321 |
| 4,424,852 | A * | 1/1984 | Hopper | 160/309 |
| 4,884,648 | A * | 12/1989 | Uchida et al. | 180/422 |
| 5,092,389 | A * | 3/1992 | Tedeschi | 160/321 |
| 6,250,359 | B1 * | 6/2001 | Lorio et al. | 160/178.1 V |
| 2006/0243502 | A1 * | 11/2006 | Weber et al. | 180/65.3 |

* cited by examiner

*Primary Examiner* — Blair M. Johnson
(74) *Attorney, Agent, or Firm* — Schmeiser, Olsen & Watts, LLP

(57) ABSTRACT

A cover for the clutch of a roller blind. The clutch includes a sprocket rotationally driven through the application of tension to a chain or cord received at least partially about the sprocket. The clutch also includes an abutment member against which a stopper on the chain or cord bears to limit rotation of the sprocket in a pre-determined direction. The cover comprises a plate member fixed to the clutch and prevented from rotation with the sprocket. The cover has a notch sized to receive at least a portion of the stopper when the stopper contacts the abutment member.

4 Claims, 4 Drawing Sheets

ROLLER BLIND CLUTCH COVER WITH ANTI-JAM BALL STOP FEATURE

FIELD OF TECHNOLOGY

This invention relates generally to roller blinds, or roller shades as they are sometimes referred to, and in particular to a roller blind clutch cover with an anti-jam ball stop feature.

BACKGROUND

Many roller blinds include a clutch mechanism that is driven by a cord or chain to impart rotational movement to the roller tube for purposes of winding or unwinding blind fabric. Roller blind clutches typically include a sprocket that is situated between a back plate and a cover plate. The cover plate commonly encases at least a portion of the outer side and circumferential surfaces of the sprocket. The rope or chain of the blind is received about the sprocket, between the back and cover plates. When the blind is installed a stopper is typically fastened to the chain or cord to govern the extent of the rotational movement of the sprocket in a particular direction. That is, to "set" the maximum amount of blind fabric that can be unwound from the roller tube a stopper may be secured to the chain or cord at a position that causes the stopper to contact the clutch's back plate and/or cover plate when a desired amount of blind fabric has been unwound. The contact between the stopper and the clutch plate or plates prevents the receipt of further chain or cord about the sprocket and thereby prevents further rotation of the sprocket. To that end, the stoppers are usually larger than the diameter of the chain or cord and can be in the shape of a ball or a barrel, but could also be various other shapes.

For aesthetic purposes, many consumers and retailers of roller blinds prefer stoppers in the shape of balls. In addition, consumers generally prefer small ball stoppers as they look less intrusive on the chain or cord as it hangs downwardly from the roller blind. Smaller ball stoppers can also be slightly cheaper to manufacture than larger ones. Unfortunately, it has been found that small ball stoppers have a tendency to become jammed between the back plate and the clutch cover plates. In some instances the jamming of the ball stopper between the back and cover plates can necessitate the removal of the blind from the end brackets and a disassembly of the clutch mechanism in order to release the stopper. In other cases, if sufficient tension is applied to the chain or cord the small ball stopper can become wedged between the back plate and the clutch cover plate, causing the plates to be displaced outwardly from one another to a degree that can cause the chain or cord to slip. The jamming of the ball stopper between the cover plates could also potentially damage the clutch.

SUMMARY

The invention therefore provides a cover for the clutch of a roller blind, the clutch including a sprocket rotationally driven through the application of tension to a chain or cord received at least partially about the sprocket, the clutch including an abutment member against which a stopper on the chain or cord bears to limit rotation of the sprocket in a pre-determined direction, the cover comprising a plate member fixed to the clutch and prevented from rotation with the sprocket, the cover having a notch sized to receive at least a portion of the stopper when the stopper contacts the abutment member.

In a further aspect the invention provides a cover for the clutch of a roller blind, the clutch including a sprocket rotationally driven through the application of tension to a chain or cord received at least partially about the sprocket, the clutch including a first abutment member against which a stopper on the chain or cord bears to limit rotation of the sprocket in a first direction, the clutch including a second abutment member against which a stopper on the chain or cord bears to limit rotation of the sprocket in a second direction, the cover comprising a plate member fixed to the clutch and prevented from rotation with the sprocket, the cover having a pair of notches, one of said notches adjacent to the first abutment member and one of said notches adjacent to the second abutment member such that when the stopper contacts one of the abutment members at least a portion of the stopper is received within the adjacent notch in said plate member to thereby limit the displacement of said plate member by the stopper.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DETAILED DESCRIPTION

The present invention may be embodied in a number of different forms. The specification and drawings that follow describe and disclose some of the specific forms of the invention.

Figure 1:
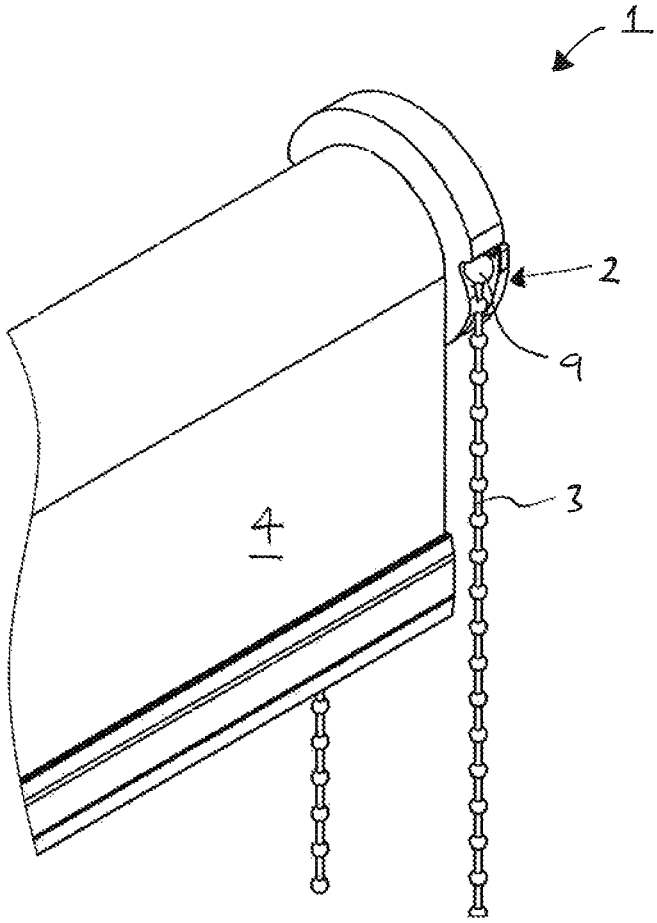
FIG. 1 is a partial upper side perspective view of a roller blind (having its end bracket removed) incorporating a roller blind clutch cover constructed in accordance with an embodiment of the invention.

In FIG. 1 there is shown a relatively generic roller blind 1 that includes a clutch mechanism 2, a ball chain 3, and blind fabric 4. For purposes of the present invention, various other aspects of roller blind 1 have not been shown in FIG. 1, however, it should be understood that the roller blind would typically include additional features, including end brackets.

Figure 3:
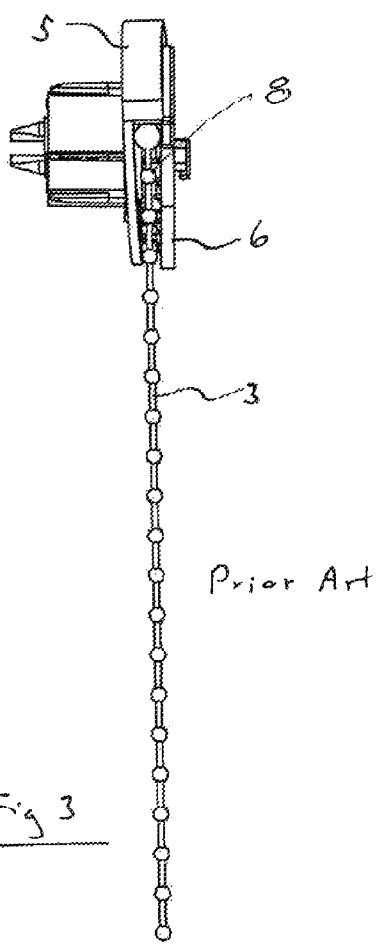
FIG. 3 is a side elevational view of the clutch assembly shown in FIG. 2.
Figure 2:
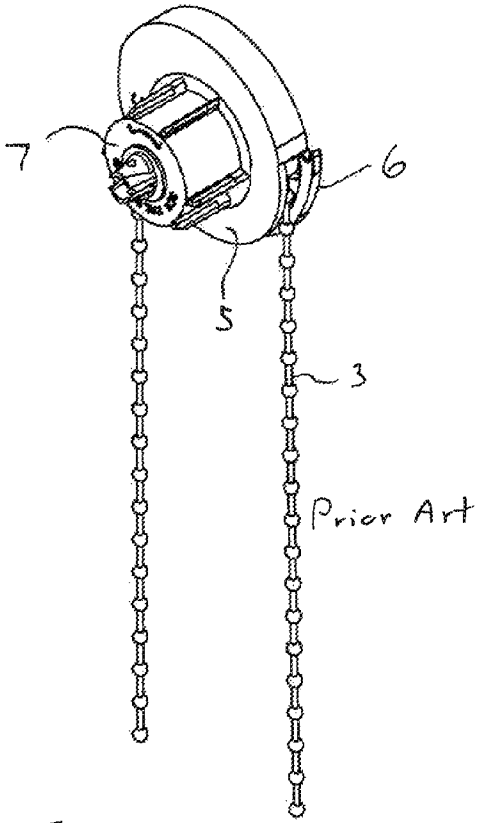
FIG. 2 is an upper side perspective view of a roller blind clutch assembly as is common in the prior art.
Figure 4:
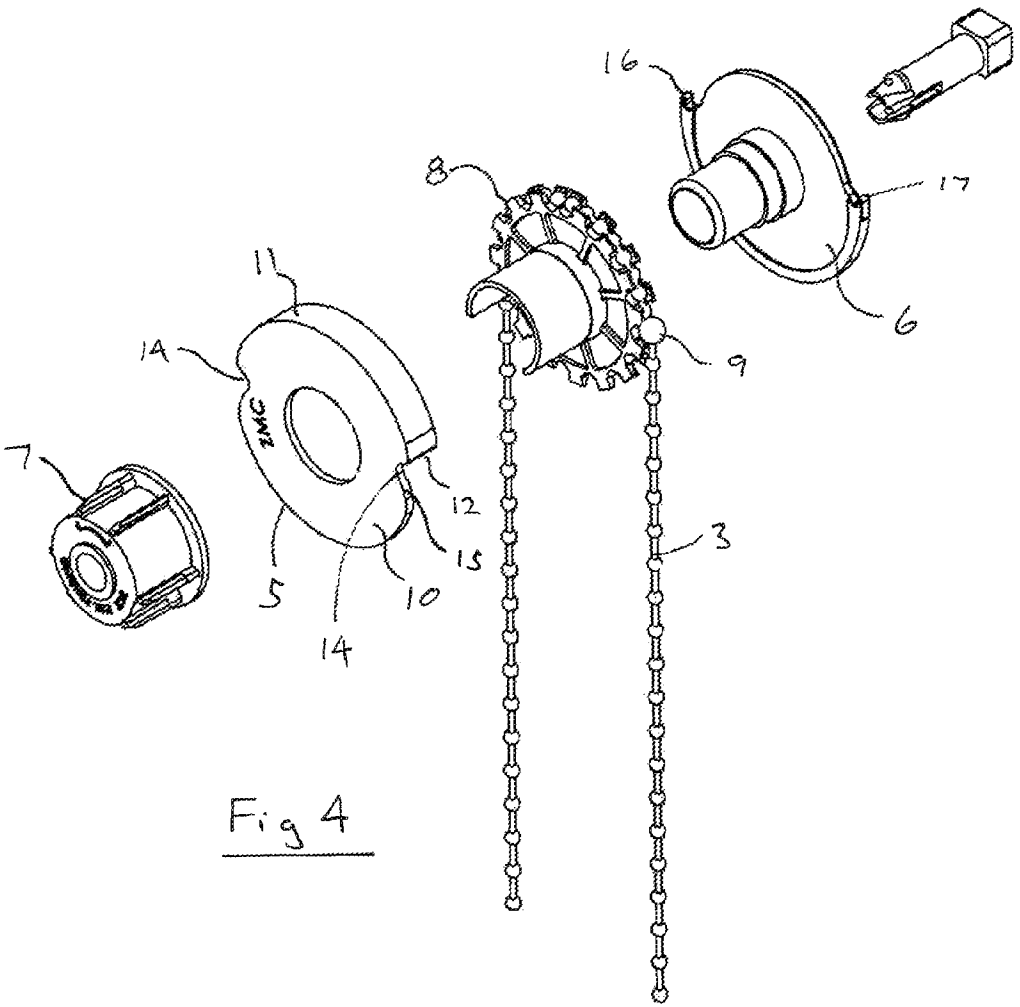
FIG. 4 is an exploded view of a clutch assembly incorporating a cover constructed in accordance with an embodiment of the present invention.
Figure 7:
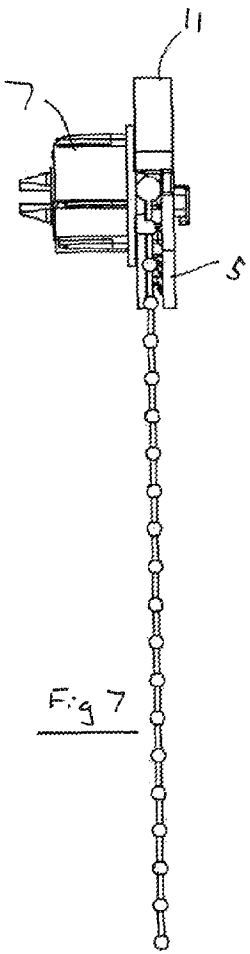
FIG. 7 is a front elevational view of the clutch assembly shown in FIG. 5.
Figure 6:
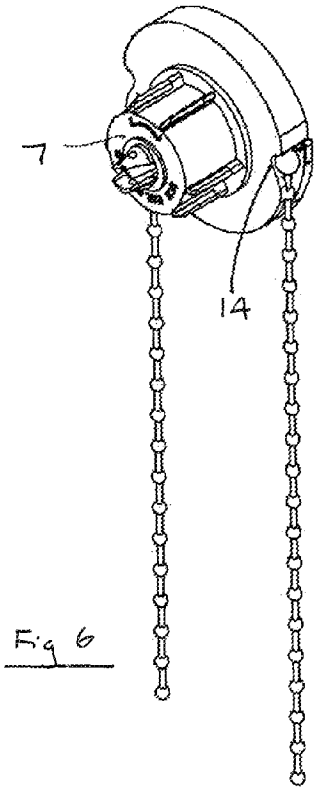
FIG. 6 is an upper side perspective view of the clutch assembly shown in FIG. 5.
Figure 5:
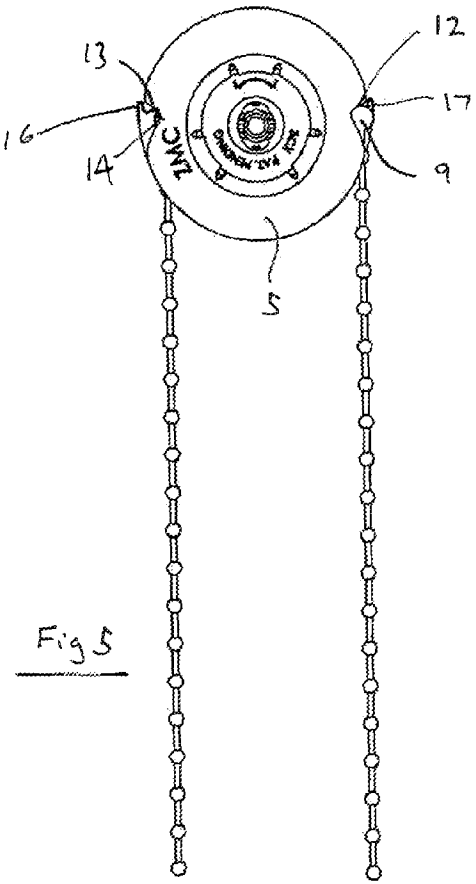
FIG. 5 is a side elevational view of a roller blind clutch assembly incorporating a cover constructed in accordance with an embodiment of the present invention.

FIGS. 2 and 3 depict a common clutch assembly that is used in present day roller blinds. The clutch assembly is comprised generally of a front cover or cover plate 5, a back plate 6, a roller tube drive member 7, and a sprocket 8. As is common with many such clutch assemblies, ball chain 3 is looped around the sprocket. One end of the chain is pulled (i.e. placed in tension) in order to impart rotational movement of the sprocket in a first direction with the opposite end of the chain being pulled to rotate the sprocket in an opposite second direction.

As mentioned previously, for largely aesthetic reasons, consumers and manufacturers generally prefer the use of a relatively small, round, ball stopper 9 on the chain (which in some cases could be a cord) that contacts abatement abutment members in order to limit the extent to which the sprocket can be rotated, and hence the amount of fabric that can be unwound from the roller tube or wound back upon the tube. As is shown particularly in FIG. 3, when such stoppers contact the clutch mechanism, they can have a tendency to be drawn into the space between the cover plate and back plate, causing one or more of the plates to be displaced outwardly. In the normal course the plates are held a fixed distance apart, with the distance being largely determined by the size of the chain or cord used to drive the sprocket. One of the functions of the plates are to help retain the chain or cord in position on the sprocket and to prevent it from "jumping" across the upper surface of the sprocket. If the chain or cord were allowed to "jump" between the teeth or sockets on the sprocket, the clutch mechanism could become jammed, could be damaged or, at the very least, the stopper would no longer be positioned in its desired location. Accordingly, the tendency for ball stoppers to become jammed between the back and cover plates, and to displace one or both of the plates, can have significant impact on the functionality of the clutch and the blind.

With reference to FIGS. 4 through 7, in accordance with an embodiment of the present invention, the cover or cover plate 5 is comprised of a plate member 10 that may have a flange 11 that at least partially encompasses a portion of the exterior circumference of the sprocket. In this instance, flange 11 encompasses generally the upper half of the exterior circumference of the sprocket. Flange 11 includes a pair of end portions 12 and 13 which act as abutment members and, against which stopper 9 can bear in order to limit rotation of the sprocket in a first or an opposite second direction, beyond a predetermined extent. That is, stopper 9 will be positioned upon chain or cord 3 at a location such that when the chain is pulled and the stopper comes into contact with one of ends 12 or 13, the blind fabric will have been rewound onto (or unwound from) the roller tube to a predetermined extent. It will be appreciated that an installer of the blind can position the stopper at a location to "set" the amount of fabric that can be unwound from the roller tube in order to accommodate the height of the window at hand. Similarly, a second stopper could be applied to the opposite portion or leg of the chain that extends downwardly from the sprocket. That second stopper could be positioned to prevent the winding of the fabric back onto the roller tube beyond a predetermined extent.

Once again with reference to FIGS. 4 through 7, in accordance with the invention plate 10 includes a notch 14 that is adjacent to one of the abutment members. In the embodiment of the invention shown in the attached drawings the abutment members are ends 12 and 13 of flange 11 and plate 10 includes two such notches 14, one positioned adjacent to each of ends 12 and 13.

Notches 14 are sized to receive at least a portion of stopper 9 therein when the stopper contacts the associated end of flange 11. Since in most instances it is expected that stopper 9 will be generally spherical in shape, in one embodiment notches 14 are generally concave and rounded in order to receive a portion of the exterior surface of the stopper. Further, the plate member adjacent to notches 14 may include a sloped "lead-in" portion 15 that can further assist in directing a portion of the exterior surface of the stopper into the concave forming the notch. It will, however, be appreciated by those having a thorough understanding of the invention that notch 14 could take any one of a wide variety of other geometric shapes and could be present without sloped lead-in portion 15.

To rigidly affix plate member 10 and flange 11 in position, and to prevent their rotation with sprocket 8, in the embodiment of the invention shown in the attached drawings, ends 12 and 13 of flange 11 engage hook portions 16 and 17 on back plate 6.

Bearing in mind the above described structure and that as shown in the attached drawings, it will be appreciated that when chain or cord 3 is pulled in a direction that causes stopper 9 to contact one of ends 12 and 13 of flange 11, the tendency for the stopper to be drawn into the space between cover 5 and back plate 6 will be reduced on account of the incorporation of notch 14 into plate member 10. The utilization of notch 14 allows the stopper (or at least a portion of the stopper) to extend beyond the inner face of plate 10 without splaying the back and cover plates apart. Since the back and cover plates are not displaced in an outward direction, the likelihood of the stopper become jammed between the plates is diminished. It will be further understood that notches 14 could be incorporated into both the cover and the back plates. However, since in many instances the back plate is positioned in very close proximity to a metallic end plate of the roller blind, the ability of the back plate to be displaced outwardly is usually very slight. In most instances, it is the cover plate that is displaced outwardly when the stopper becomes jammed between the cover and back plates, hence, the utility of notch 14 tends to be greatest when positioned within the cover plate.

Accordingly, from a thorough understanding of the invention it will be appreciated that the clutch cover diminishes the likelihood of a ball stopper becoming jammed through operation of the clutch and its associated ball chain or cord. As the ball stopper comes into contact with an abutment member of the clutch (which in the case of the embodiment shown in the attached drawings is one of ends 12 or 13). A portion of the stopper will be able to extend into notch 14 without displacing or splaying the front and/or rear cover plates of the clutch in an outward direction. There will thus be a significantly reduced likelihood of the stopper becoming jammed within the clutch mechanism, thereby minimizing the negative effects that can occur should the ball stopper become jammed. The nature of notch 14 in combination with sloped lead-in portion 15 also facilitates both the receipt of a portion of the ball stopper within the notch and its extraction from the notch when the ball chain or cord is pulled in an opposite direction.

It is to be understood that what has been described are the preferred embodiments of the invention. The scope of the claims should not be limited by the preferred embodiments set forth above, but should be given the broadest interpretation consistent with the description as a whole.

What is claimed is:

1. A cover for a clutch of a roller blind, the clutch including a sprocket rotationally driven through the application of tension to a chain or cord received at least partially about the sprocket, the cover comprising:

a plate member fixed to the clutch and prevented from rotation with the sprocket, the plate member including:

two abutment members against which a stopper on the chain or cord bears to limit rotation of the sprocket, one of the two abutment members assisting in limiting rotation of the sprocket in a first direction and the other of the two abutment members assisting in limiting rotation of the sprocket in a second, opposite direction; and two notches generally concave in configuration and sized to receive at least a portion of an exterior surface of the stopper when the stopper contacts one of the two abutment members, one of the two notches adjacent to one of the two abutment members and the other of the two notches adjacent to the other of the two abutment members.

2. The cover as claimed in claim 1 wherein the two notches include sloped lead-in portions to assist in directing at least a portion of said stopper into said concavities.

3. The cover as claimed in claim 1 wherein said plate member includes a flange to at least partially encompass a portion of the exterior circumference of the sprocket, the two abutment members comprising end portions of said flange, the two notches adjacent to the end portions of the flange.

4. The cover as claimed in claim 3 wherein said end portions of said flange engage a back cover of the clutch to prevent rotational movement of said plate member.

* * * * *

UNITED STATES PATENT AND TRADEMARK OFFICE

CERTIFICATE OF CORRECTION

PATENT NO. : 8,726,972 B1
APPLICATION NO. : 13/746353
DATED : May 20, 2014
INVENTOR(S) : Norman Wills It is certified that error appears in the above-identified patent and that said Letters Patent is hereby corrected as shown below:

In the Specification

COLUMN 3

Line 7, delete "abatement"

Signed and Sealed this
Ninth Day of September, 2014

Michelle K. Lee

Michelle K. Lee
*Deputy Director of the United States Patent and Trademark Office*